US005454388A

United States Patent [19]

Glaiman et al.

[11] Patent Number: 5,454,388

[45] Date of Patent: Oct. 3, 1995

[54] STRIP PRODUCT PROCESSING INSTALLATION

[75] Inventors: Gérard Glaiman, Saint-Mande; Daniel Sylvain, Paris, both of France

[73] Assignee: Clecim, Cergy-Pontoise, France

[21] Appl. No.: 290,635

[22] Filed: Aug. 16, 1994

[30] Foreign Application Priority Data

Aug. 17, 1993 [FR] France ..... 93 10055

[51] Int. Cl.[6] ..... B08B 3/08

[52] U.S. Cl. ..... 134/64 R

[58] Field of Search ..... 134/64 R, 64 P, 134/122 R, 122 P; 266/112

[56] References Cited

U.S. PATENT DOCUMENTS

| | | | |
|---|---|---|---|
| 2,216,544 | 10/1940 | True et al. | 134/64 R |
| 3,054,162 | 9/1962 | Amtmann . | |
| 4,944,808 | 7/1990 | Sugiyama et al. | 134/64 R X |
| 4,986,291 | 1/1991 | Hula et al. | 134/122 R |

FOREIGN PATENT DOCUMENTS

| | | | |
|---|---|---|---|
| 2051205 | 4/1972 | Germany | 266/112 |
| 86882 | 4/1988 | Japan | 134/64 R |
| 520129 | 4/1940 | United Kingdom . | |
| 2111084 | 6/1983 | United Kingdom | 134/122 R |

OTHER PUBLICATIONS

"Pickling Method for Metal Strip" Patent Abstracts of Japan, vol. 11, No. 316 (M-631) 1987 & JP-A-62 101 317 (Nippon Steel). Oct. 14, 1987.

"Descaling Method for Hot Rolling Steel Strip" Patent Abstracts of Japan, vol. 11, No. 210 (M-604) 1987 & JP-A-62 028 020 (Sumitomo Metal Ind.) Jul. 8, 1987.

*Primary Examiner*—Philip R. Coe

*Attorney, Agent, or Firm*—Nikaido, Marmelstein, Murray & Oram

[57] ABSTRACT

The object of the invention is a processing installation, particularly a metal strip pickling installation, comprising a series of vats (2) filled with a pickling liquid (20), each vat (2) being separated from adjacent vats by two bulkheads. The upper portion of these bulkheads has a sill located above the level of the liquid (20) and which supports the strip (1). According to the invention, each sill (22) is fitted with a support part limited by a rounded, upwardly convex, contact face (4) on which a liquid recovery groove is provided. This liquid recovery groove extends along the upper part of the supporting part at right angles to the strip feed direction, and is extended, at at least one of its ends, by a return channel leading to the upstream vat (2*a*). The bottom (53) of the groove (5) and return channel (6) are downwardly inclined to allow the liquid recovered in the groove (5) to return naturally to the upstream vat (2*a*).

10 Claims, 2 Drawing Sheets

STRIP PRODUCT PROCESSING INSTALLATION

BACKGROUND OF THE INVENTION

1. Field of the Invention

This invention relates to a strip product processing installation, and in particular an installation for acid pickling a metal strip.

2. Background Information

In the production of metal strips by rolling, it is customary at the end of rolling to pass the strip into a pickling line made up of a series of vats filled with a pickling liquid such as an acid solution.

The different elongated vats are arranged one after another along longitudinal feed axis of the strip, each vat being separated from adjacent vats by two bulkheads, respectively upstream and downstream, located at right angles to the strip feed direction, and each having, at its upper portion, a sill above the liquid to support the strip. The strip therefore follows an undulating path forming a loop in each vat which starting from the upstream sill, dips into the liquid and then emerges from the liquid at the other end to pass onto the downstream sill and dip into the following vat.

To maintain pickling efficiency, the acid solution, which progressively becomes charged with iron, has to be regenerated. Since the solutions contained in the different vats are titrated differently, the acid is generally made to circulate in counterflow fashion, the most downstream vat being fed with new acid and the most upstream vat returning the solution with the highest iron content to a regeneration installation.

Any risk of the strip becoming scored at each sill must also be avoided. To achieve this, the sills can be made up of deflection rollers turning about a horizontal axis perpendicular to the strip feed direction. Such rollers, however, must be supported by bearings that can become rapidly damaged on contact with the acid. For this reason fixed sills are generally used, the metal strip sliding on them as it passes from the upstream vat to the downstream vat, such a sill being made from a material that resists both the action of the acid and the wear caused by the passage of the strip.

However, the sliding of the strip on each sill can cause grooves detrimental to the surface state of the strip which must be kept as perfect as possible. This risk is averted thanks to the dynamic carrying forward, with the strip, of a certain quantity of liquid that forms a film that interposes between the strip and the sill. The strip is thus supported, on each sill, by a sort of liquid cushion and, in addition, the friction that might lead to wear and tear on the sill is reduced.

However, a certain amount of acid is also carried forward by the strip and passes from one vat to the next in the strip feed direction. This modifies the dosing of the solution in each vat, and may adversely affect pickling efficiency.

To overcome this drawback, each sill between two vats can be associated with drying rollers which limit the amount of acid carried downstream, but such a solution is relatively expensive and results in high maintenance costs, with the different moving parts working in an acid atmosphere. Such drying rollers can also cause the band to deviate. Moreover, while such an arrangement can be envisaged in new installations, it cannot easily be adapted to existing vats.

The invention provides a solution for all these problems thanks to simple arrangements which make it possible to perfect the working of the sills between the vats by preventing an excessive amount of acid being carried downstream and which, moreover, can be adapted to existing installations.

SUMMARY OF THE INVENTION

According to the invention, each sill between an upstream vat and a downstream vat, in the strip feed direction, is limited by a rounded, upwardly convex contact face that has an upwardly open pickling liquid recovery groove running along the upper portion of the sill at right angles to the strip feed direction, said groove being prolonged by at least one return channel leading into the upstream vat, the bottom of the groove and said return channel being downwardly inclined to allow the liquid recovered in the groove to return naturally to the upstream vat.

In a particularly advantageous way, the recovery groove is made downstream of the highest point of the rounded contact face of the support sill and the portion of the rounded contact face located downstream of the groove is slightly downwardly offset with respect to the passing line of the strip, so as to allow the strip to unstick after passing over the groove.

According to a first embodiment, the bottom of the recovery groove is inclined slightly downward over the entire width of the sill, between an upper side and lower side which leads into a return channel placed along the lower side and inclined towards the upstream vat so as to return the recovered liquid into it.

According to another embodiment, the recovery groove leads into two return channels placed respectively at each of its ends on the two lateral sides of the support sill and inclined towards the upstream vat, the bottom of the groove being inclined symmetrically with respect to the horizontal towards the two channels starting from the middle of the groove.

However according to another embodiment, it is also possible to incline the bottom of the slot symmetrically downwards starting from the two lateral ends up to a lowest point located substantially in the middle of the groove and which leads into a single return channel made in the central portion of the support sill and inclined towards the upstream vat.

According to another particularly advantageous embodiment, a support sill such as that of the invention can be made up of a single block comprising a lower face for mounting the block onto the bulkhead, a rounded upper face for guiding the strip and two side faces each comprising an edge projecting above the guiding face, parallel to the strip feed direction, for guiding the strip.

Such a sill can be made from a molded acid-resistant material, but it is particularly advantageous to use, for this purpose, a natural rock of eruptive origin, particularly lava from the Volvic region in France, which can be machined into the various shapes required.

BRIEF DESCRIPTION OF THE DRAWINGS

The invention will be better understood from the following non-limiting description of a particular embodiment of the invention given for the purposes of an example. It must be read in conjunction with the attached drawings in which.

DESCRIPTION OF THE PREFERRED EMBODIMENTS

Figure 1:
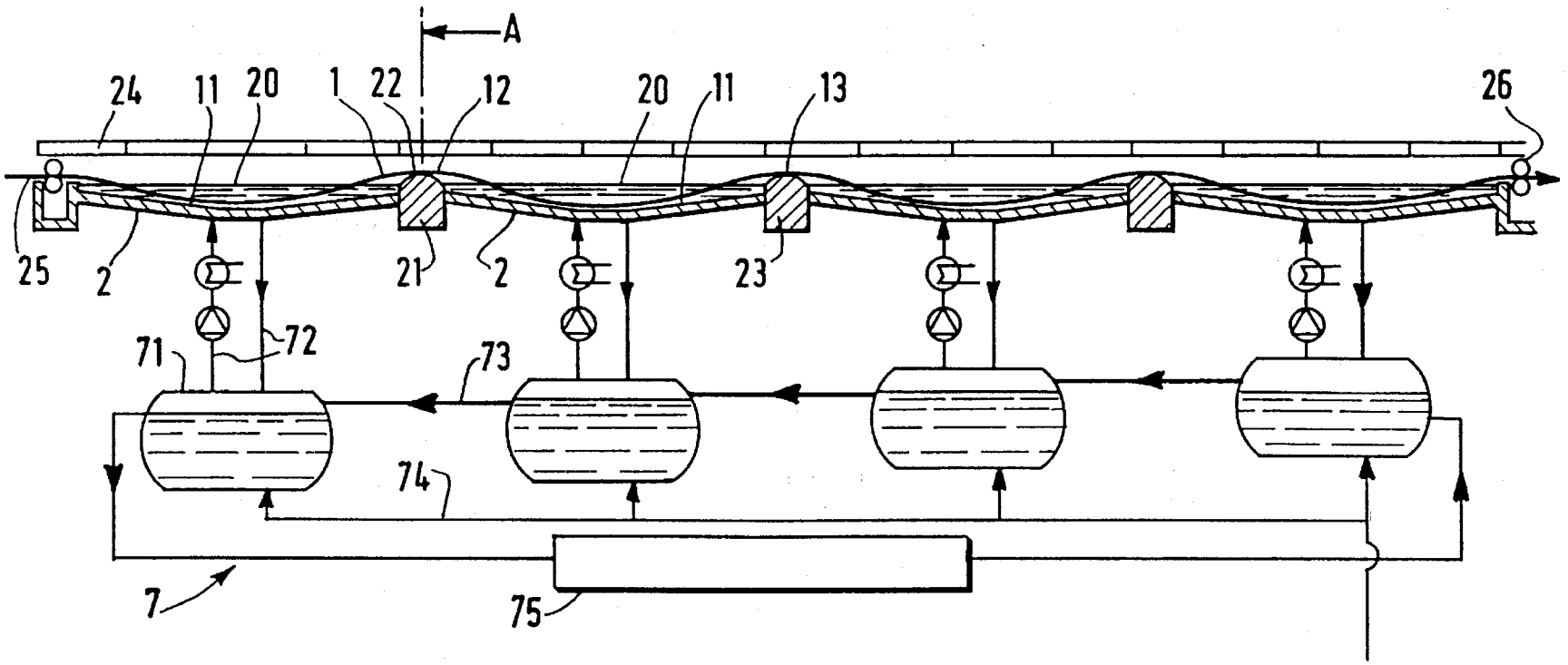
FIG. 1 is a general schematic view in the form of a longitudinal section of a metal strip pickling installation.

FIG. 1 shows a schematic view of an entire installation for pickling a metal strip 1 comprising a series of long vats 2 separated from each other by bulkheads 21 extending upward to a level 22 located above the upper level of liquid 20 contained in the vats, in such a way that the strip 1 follows an undulating path, represented by the dot-and-dash line on the drawing, and forming, in each vat 2, a loop 11 which dips into liquid 20 between a crossing summit 12 on upstream bulkhead 21 of vat 2 and the following crossing summit 13 on downstream bulkhead 23.

The whole installation is covered by a cover 24 for recovering acid vapors, associated with an upstream seal 25 and a downstream seal 26 which provide sealing against vapors, comprising, for example, rollers between which strip 1 passes.

Moreover, the vats 2 are associated with means 7 for circulating and regenerating the acid liquid comprising, for example, a plurality of storage tanks 71 associated, respectively, with each vat 2 via a supply and return circuit 72, said storage tanks being interconnected by a closed circuit 73 for circulating the acid from one tank to the preceding one, in the opposite direction to the strip feed direction, the liquid recovered upstream passing into a regeneration unit 75. In addition, each tank is connected individually to a circuit 74 for supplying new acid.

It can be seen that such an installation makes it possible to adjust, in each storage tank 71, the concentration of the solution 20 in the corresponding vat 2. However, the carrying forward with strip 1 of a certain amount of acid towards the downstream vat risks upsetting the regulation of concentrations.

Figure 3:
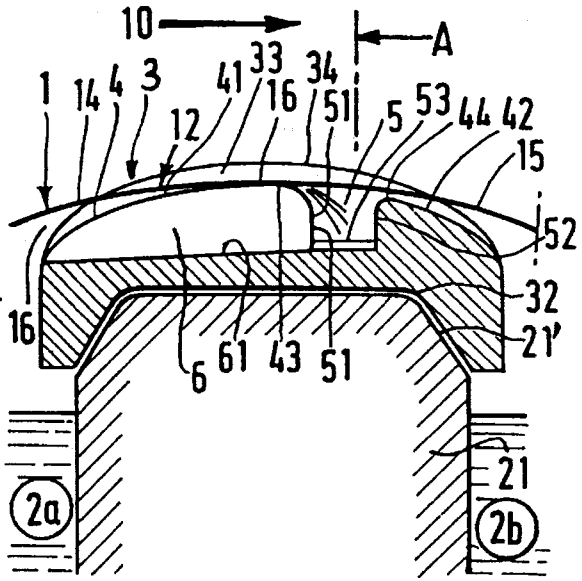
FIG. 3 is a cross-section view along section B of FIG. 2.
Figure 2:
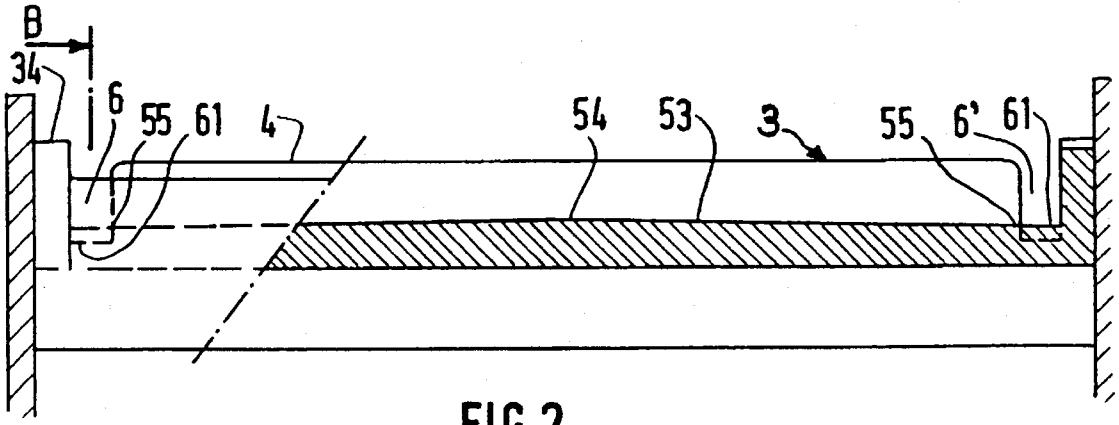
FIG. 2 shows, on an enlarged scale, a cross-section of a support sill of the invention along direction A of FIG. 1.
Figure 4:
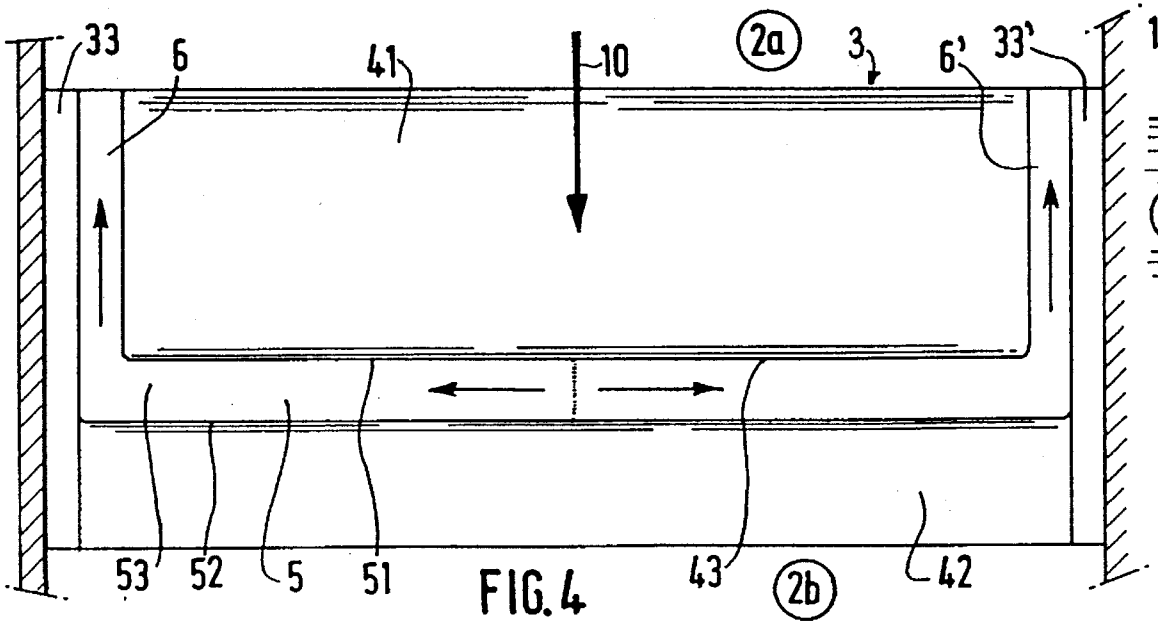
FIG. 4 is an above view of the support sill.

The support sill of the invention, shown in detail in FIGS. 2, 3 and 4 overcomes this drawback.

The upper portion of a bulkhead 21 separating two successive vats **2*a* and 2*b* is shown in FIG. 3, and is equipped with a sill 3 made up of a long part extending along the upper portion of bulkhead 21, at right angles to the strip feed direction, and comprising an upper face 4 for guiding the strip and a lower face 32 which is preferably hollowed out in the form of an inverted U, so as to cover the upper portion 21' of bulkhead 21**.

The upper face 4 of part 3 has a convex, rounded profile in the form of a cylinder whose generating lines are perpendicular to feed axis 10. According to the invention, a groove 5 is hollowed out in the central portion of part 3 in such a way that the rounded face 4 is divided into two portions, respectively, a first portion 41 placed upstream of groove 5 and a second portion 42 placed downstream of groove 5.

Preferably, groove 5 is arranged so as to be entirely downstream of the highest point 16 of strip 1 which, in longitudinal section, substantially forms an arc of a circle 14 tangent at point 16 to the upper portion of the rounded face 4 which connects, via a rounded edge 43, to the front face 51 of groove 5.

The radius of curvature of the rounded support face 4 is slightly less than that of line 14 followed by strip 1 when passing onto sill 3, such that the upstream portion 41 of supporting face 4 forms with the corresponding portion of strip 1 a space 16 in the form of a corner into which a certain amount of liquid carried along with the strip engages, and which forms a fluid film on support face 4 that makes it possible to avoid direct contact and rubbing with strip 1 but which is limited to the upstream portion 41 of rounded face 4, the carried liquid separating from strip 1 immediately after edge 43 to fall into groove 5.

The downstream portion 42 of the support face connects to the rear side 52 of groove 5 via a rounded edge 44 which, because of the difference in the radii of curvature, is located slightly below the corresponding portion 15 of the strip and does not therefore come into contact with it. To avert any risk of contact, it is also possible to lower the level of upper edge 44 even further with respect to the natural feed line 15 of strip 1.

In the example shown in the drawings, the two ends of groove 5 lead, respectively, into two channels 6, 6', each provided along a lateral edge 33, 33' of part 3, parallel to strip feed direction 10, each channel 6, 6' extending upstream starting from the end of groove 5 so as to discharge upstream into vat **2*a***.

Bottom 53 is downwardly inclined starting from the middle 54 of the groove up to its two ends 55 leading into the two lateral channels 6, 6', the bottom 61 of which is also downwardly inclined up to the end discharging into upstream vat **2*a***.

As a result, the liquid carried forward by strip 1 and recovered by groove 5 is returned naturally, by gravity, to upstream vat **2*a*, by following the two portions of groove 5, then the two return channels 6, 6'**.

Preferably, the two lateral sides 33, 33' of support part 3 form an edge whose upper face 34 is located slightly above support face 4 so as to maintain strip 1 in position on sill 3 in the event of lateral deviation. It should noted, however, that the liquid film interposed between strip 1 and sill 3 extends only over a short distance since it does not pass summit 43 of supporting face 4. The risks of deviation are therefore small.

It can be seen that the support sill just described has many advantages.

First, the fact that virtually all the acid solution carried along with the strip can be recovered by groove 5 and sent to the upstream vat **2*a*** greatly facilitates regulating the concentration of the solution in each vat.

Secondly, given the simplicity of the device, the investment cost is small and, moreover, it is possible to fit such sills onto existing vats since it is simply a question of equipping the upper portion of each bulkhead 21, this being simply covered by the sill of the invention.

Thirdly, such a sill can advantageously be produced from a moldable or machinable material that is resistant to acid. In particular, natural crystalline rock or eruptive rock could be used which are very resistant to acid and capable of being machined into the required shapes. Granite or lava rock from the Volvic region in France are ideal for such a use.

While the sill will preferably be produced as a single monoblock part to avoid risks of deterioration by corrosion, it could also be made up of a small number of parts assembled by an adequate cement.

The invention is not of course limited to the details of the embodiment just described. Other variants or improvements can also be imagined without departing from the scope of protection defined by the claims.

For example, groove 5 could be associated with a single return channel 6 placed along one of the sides 33 of the sill, the bottom of the groove then being inclined over the whole width of the sill starting from the opposite side. The return channel could also be placed in the median plane of the sill, with the bottom of groove 5 inclined symmetrically from the two lateral sides up the middle of the groove.

In addition, as shown in the diagrams, return channels 6, 6' are advantageously made up of grooves each forming an upwardly-open channel. It would also however be possible to drill, in the thickness of the supporting part 3, one or more tunnels leading at each end, respectively, into recovery groove ,5 and upstream vat 2*a*, said tunnel being inclined in the opposite direction to the strip feed direction.

What is claimed:

1. Strip product processing installation comprising a series of vats filled with liquid and in which the strip product successively passes by traveling along a longitudinal axis, each vat being separated from adjacent vats by two bulkheads, respectively upstream and downstream, located at right angles to the strip feed direction, each bulkhead having, at its upper portion, a support sill for the strip, located above the level of the liquid, in such a way that the strip follows an undulating path comprising, for each vat, a loop that dips into the liquid between two crossing summits on the two sills placed respectively upstream and downstream in the strip feed direction wherein each sill is fitted with a support part limited by a rounded, upwardly convex contact face on which a liquid recovery groove is provided, extending along the upper portion of the support part, at right angles to the strip feed direction, and upwardly open, said groove being prolonged by at least one return channel leading into the upstream vat, the bottom of the groove and said return channel being downwardly inclined to allow the liquid recovered in the groove to naturally return to the upstream vat.

2. The processing installation of claim 1 wherein the recovery groove is made downstream of the highest point of the rounded contact face of the support part.

3. The processing installation of claim 1 wherein the rounded contact face of the support part is made up of two portions, respectively upstream and downstream, on either side of the recovery groove, the downstream portion being offset slightly downwards with respect to the natural feed line of the strip passing over the upstream side so as to allow the strip to unstick downstream of the groove.

4. The processing installation of any one of claims 1 to 3 wherein the bottom of the recovery groove is inclined slightly downward, over the entire width of the support part, between an upper side and a lower side which leads into a return channel placed along a lateral side of the part and whose bottom is inclined towards the upstream vat in order to return the recovered liquid into it.

5. The processing installation of any one of claims 1 to 3 wherein the recovery groove leads into two side return channels placed respectively at each of its ends along the two lateral sides of the support part and inclined towards the upstream vat, the bottom of the groove being inclined symmetrically with respect to the horizontal towards the two channels starting from the middle of the groove.

6. The processing installation of any one of claims 1 to 3 wherein the bottom of the groove is inclined symmetrically downwards starting from its two lateral ends to a lowest point located substantially in the middle of the groove and which leads into a single return channel provided in the central portion of the support part and inclined towards the upstream vat.

7. The processing installation of any one of claims 1 to 3 wherein each return channel is made up of a groove forming an upwardly-open channel.

8. The processing installation of any one of claims 1 to 3 wherein each return channel is made up of a tunnel drilled in the thickness of the support part and leading, at its two ends, respectively, into the recovery groove and the upstream vat.

9. The processing installation of claim 1 wherein each support part is made up of a single block comprising a lower face for mounting onto the bulkhead, a rounded upper face for guiding the strip and two lateral faces each comprising an edge for guiding the strip, said edge projecting above the guide face, parallel to the strip feed direction.

10. The processing installation of claim 9 wherein each support part is made from natural rock of eruptive origin that is resistant to acid and capable of being machined.

* * * * *